United States Patent [19]

Holmes

[11] 4,033,836

[45] July 5, 1977

[54] ELECTROLYTIC REDUCTION CELL

[75] Inventor: G. Thomas Holmes, Badin, N.C.

[73] Assignee: Aluminum Company of America, Pittsburgh, Pa.

[22] Filed: Oct. 21, 1976

[21] Appl. No.: 734,612

[52] U.S. Cl. ..... 204/67; 204/243 R

[51] Int. Cl.[2] ..... C25C 3/06; C25C 3/08

[58] Field of Search ..... 204/67, 243 R–247

[56] References Cited

UNITED STATES PATENTS

| | | | |
|---|---|---|---|
| 3,607,685 | 9/1971 | Johnson | 204/67 |
| 3,723,286 | 3/1973 | Hunt et al. | 204/243 R |
| 3,787,310 | 1/1974 | Johnson | 204/243 R |

*Primary Examiner*—John H. Mack
*Assistant Examiner*—D. R. Valentine
*Attorney, Agent, or Firm*—Andrew Alexander

[57] ABSTRACT

An improved electrolytic reduction cell comprises a metal shell, a layer of carbonaceous material permeable by sodium and an insulative layer of aluminum fluoride disposed intermediate the metal shell and the layer of carbonaceous material, the aluminum fluoride being reactive with the sodium permeating the carbonaceous layer thereby preventing corrosion of the metal shell by the sodium.

5 Claims, 2 Drawing Figures

ELECTROLYTIC REDUCTION CELL

This invention relates to electrolytic cells for the production of aluminum. More particularly, it relates to the corrosion resistance of the metal shell of the cell.

Conventional electrolytic cells used for the production of aluminum by the Hall-Heroult process comprise generally a metal shell and a carbonaceous liner material which acts as a cathode. Interposed between the shell and liner material is a layer of insulation often comprised of alumina. Metal bars, referred to as collector bars, project from the outside of the cell through the metal shell and insulation layer into the carbonaceous cathode liner constituting the bottom of the cell. Conventionally, straps of metal, for example copper, join the end of the connector bar to a bus bar. Anodes normally project from the top of the cell into an electrolyte contained by the carbonaceous liner. Typically, the electrolyte is composed mostly of cryolite, a mixture of sodium and aluminum fluoride. Normally, the temperature of the electrolyte is about 970° C. When electricity is passed through the cell, aluminum is produced by reduction of alumina dissolved in the electrolyte.

In operation of an electrolytic cell such as described, problems are encountered which shorten the useful life of the cell requiring it to be shut down for repairs. For example, the carbonaceous liner permits material in the electrolyte to pass into the layer of insulation and henceforth through a seal around the collector bar to the outside of the metal shell. The material, identified mainly as a strongly basic sodium compound, spreads over the metal shell consequently corroding it, particularly in the vicinity of the collector bar. The problem is further compounded by the fact that the corrosive material migrates to the collector straps referred to above. The straps are susceptible to corrosive attack by the sodium material resulting in their failure in a relatively short period.

Another problem encountered is distortion of the carbonaceous liner. This occurs as a result of sodium in the electrolyte penetrating the carbonaceous liner and reacting with the alumina serving as the insulation material. As a result of the reaction, sodium aluminate forms and swells the insulation resulting in what is referred to in the art as heaving.

In the prior art, attempts have been made to solve the problem of heaving and its attendant cracking problems. For example, Johnson in U.S. Pat. No. 3,457,149 discloses a method of impregnating the carbon lining during its formation with low melting point halides such as calcium chloride or sodium chloride or mixtures thereof with each other, aluminum chloride, or with mixtures of fluorides of lower melting point than the conventional cryolite fusion. It is indicated in the patent that this impregnation of the pores and fissures is a barrier to the entry of sodium, cryolite fusion or aluminum. However, this process requires that a vacuum be applied to the area between the shell and the carbon cathode while it is being heated and baked in order to suck molten halide material of relatively low melting point provided within the cathode into the pores and fissures. Hunt et al in U.S. Pat. No. 3,723,286 discloses reducing the distortion of the carbonaceous cathode lining by incorporating a layer of salt selected from the group consisting of the chloride and fluoride salts of sodium, lithium, calcium and magnesium between the carbonaceous lining and insulating layer of refractory.

The present invention overcomes problems in the prior art and greatly extends the life of the cell by substantially eliminating the corrosion of the metal shell and collector straps as well as minimizing the heave or distortion of the carbonaceous liner.

SUMMARY OF THE INVENTION

An object of this invention is to extend the operating life of an electrolytic aluminum producing cell.

Another object of this invention is to extend the operating life of an electrolytic cell for the production of aluminum by minimizing the corrosion of the metal shell and collector straps.

These and other objects will become apparent from the drawings and specification.

In accordance with these objects, an electrolytic reduction cell comprises a metal shell, a layer of carbonaceous material permeable by sodium and a layer of aluminum fluoride disposed intermediate the steel shell and the layer of carbonaceous material, the aluminum fluoride being reactive with the sodium permeating the carbonaceous layer.

DETAILED DESCRIPTION OF THE PREFERRED EMBODIMENTS

Figure 1:
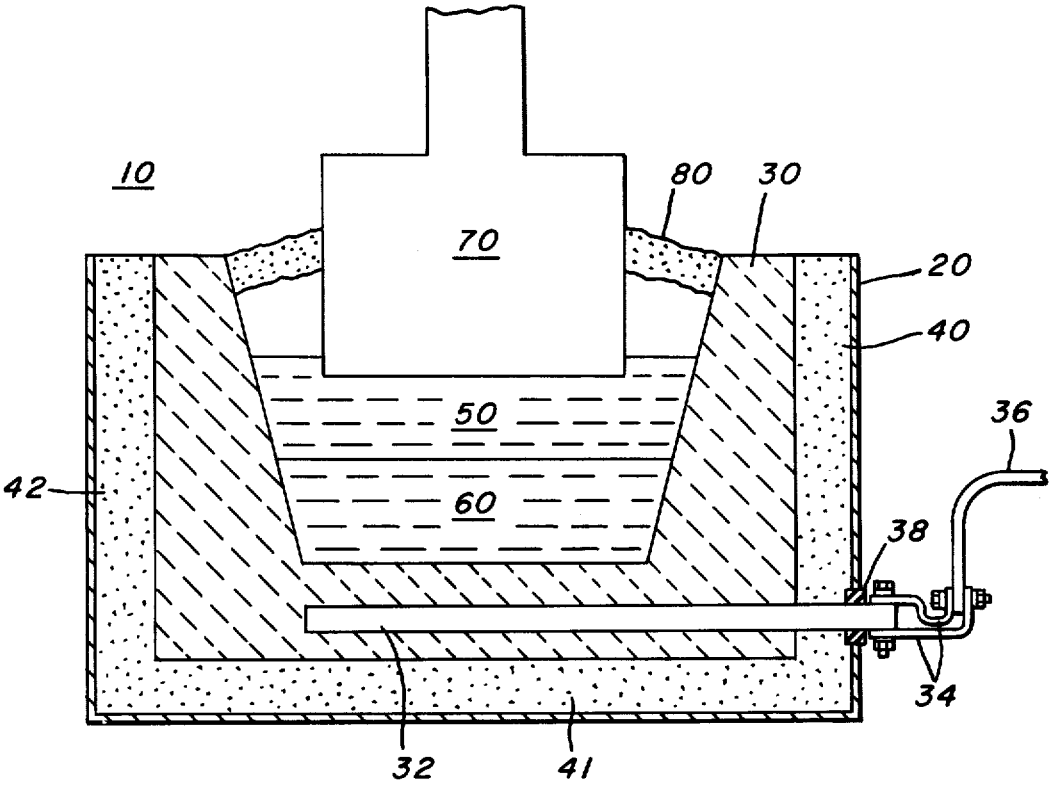
FIG. 1 is a schematic elevation in cross section of an electrolytic cell in accordance with the invention.

The present invention contemplates an improved electrolytic reduction cell 10, FIG. 1, having a metal shell 20, a layer of carbonaceous material 30 permeable or penetrable by sodium material and a layer of insulative material 40 disposed intermediate metal shell 20 and carbonaceous material 30. The insulative material is reactive with sodium material diffusing or otherwise passing through the carbonaceous material from electrolyte 50 during the operation of the cell, thus extending the useful operating life of the cell by substantially preventing corrosive attack on the metal shell. The cell has an anode 70 projecting into electrolyte 50. In the case of an aluminum production cell, a layer of alumina 80 is provided from which alumina can be fed to electrolyte 50. In the cell, the carbonaceous liner or layer 30 referred to acts as a cathode and has a bar 32, referred to as a collector bar, embedded therein. As will be seen in FIG. 1, collector bar 30 extends from cathode layer 30 through insulative layer 40 and metal shell 20 to the outside of the cell where it is joined to collector straps 34 which in turn are joined to a suitable bus bar 36. At the point where collector bar 32 passes through metal shell 20, electrical insulation 38 is provided.

In accordance with this invention, the insulative layer 40 disposed between the carbonaceous layer and the metal shell is aluminum fluoride. The aluminum fluoride layer, in powder form, can be provided in a thickness around the cell typical of that for conventional insulative materials such as alumina. Additional insulation layers of lower thermal conductivity material may be provided between the aluminum fluoride and the shell, if desired. On assembly of the cell, aluminum fluoride layer 41 may be provided to serve as a support for cathode or carbonaceous liner 30 and thereafter sides 42 may be added and compacted intermediate the carbonaceous liner and metal shell. The aluminum fluoride may also be provided in various proportions mixed with other insulative materials such as alumina; however, maximum benefit is obtained by using only aluminum fluoride.

Figure 2:
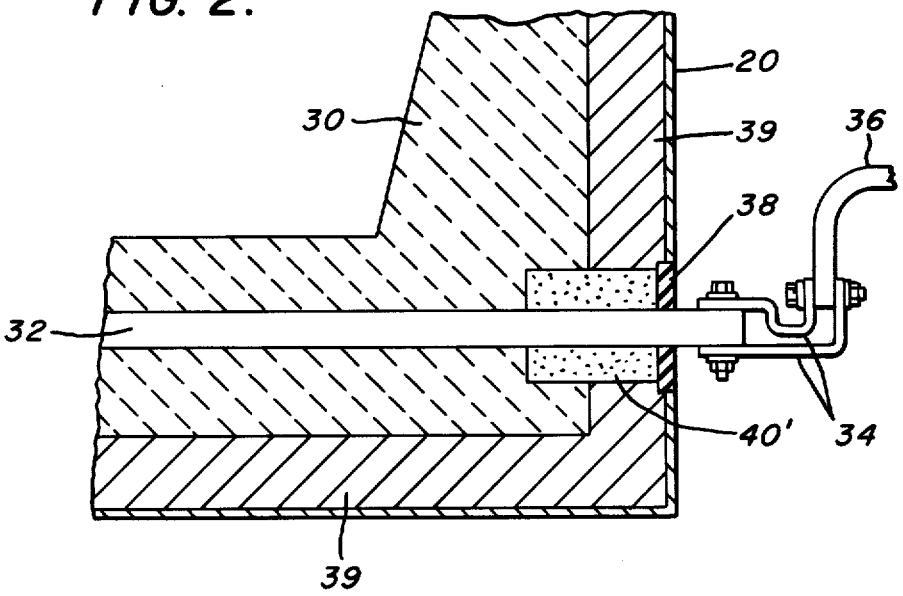
FIG. 2 is a schematic elevation in cross section of a collector bar and strap projecting from the metal shell of an electrolytic cell.

In another embodiment of the invention, aluminum fluoride may be provided in the form of sleeve 40' as shown in FIG. 2. Sleeve 40' is provided so as to completely encapsulate collector bar 32 from metal shell 20 into carbonaceous liner 30. This sleeve may only surround the bar as shown in FIG. 2 or it may extend as a layer along the cell wall encapsulating more than one collector bar. In this embodiment, conventional insulative material 39, e.g. alumina, may be used for the remaining portion of the cell requiring insulation. Aluminum fluoride provided in this embodiment acts to protect the metal shell and collector straps by reacting with sodium material migrating or diffusing through the carbonaceous liner and along the collector bar.

While the inventor does not necessarily wish to be held to any theory of invention, it is believed that aluminum fluoride acts to extend the operating life of the electrolytic cell for several reasons. When aluminum fluoride is used as the insulative material, it reacts with sodium to form compounds such as sodium aluminum fluoride and alumina ($Al_2O_3$) which are essentially neutral from the standpoint of corrosion of the metal shell. For comparison purposes, if alumina is used for the insulation layer, as is the conventional practice, it reacts to form sodium aluminate which is alkaline and is corrosive with respect to the metal shell. In addition to this theory, it is believed that aluminum fluoride is beneficial because it minimizes the amount of distortion, i.e. heaving, referred to earlier. That is, the volume occupied by the reaction products when aluminum fluoride is used is less than that occupied by the reaction products formed when alumina is used. Also, it is thought that in order to successfully neutralize the corrosion effect of sodium, e.g. $Na_2O$, passing through the carbonaceous liner it is necessary to have an insulative material which is highly reactive with sodium and forms a substantially neutral compound. That is, with respect to sodium, the material used for the insulative layer should have an electrode potential of at least one volt in order that the corrosive effect of sodium be neutralized. Thus, it is seen that the use of materials such as sodium, calcium or magnesium chloride or fluoride or the like disclosed in the Hunt patent, referred to earlier, would not be useful for such insulative applications since they provide an additional source of corrosive material, sodium, for example, which as explained is detrimental to the cell construction.

The corrosion problem is one that has plagued the industry for years. The corrosion problem initiates around seal 38 from where sodium material migrates along bar 32 to the collector straps 34 (FIG. 2) and over the sides of the metal shell. The sodium material corrodes collector straps 34 to the point where they become severed necessitating their replacement. With respect to sodium which migrates or spreads over the metal shell, its corrosive effect has been minimized in the past by scraping the sides periodically. However, this has been at best only a temporary measure, since eventually sections of the shell around the collector bar, as well as the collector straps, have to be replaced.

In order to test the present invention, a 170,000 ampere aluminum producing electrolytic cell was assembled using cryolite as an electrolyte and aluminum fluoride as an insulative material. For comparative purposes, at the same time another cell of the same size was assembled using alumina for insulative material. After operating the cells for 1600 days, it was found that the cell insulated with aluminum fluoride was free of any sodium material on the sides or on the collector straps. By comparison the sides and the collector straps of the cell insulated with alumina were found to be substantially covered with the corrosive sodium materials. Thus, it can be seen that the use of aluminum fluoride has a highly beneficial effect in extending the operating life of the electrolytic cell. That is, in this period of 1600 days corrosion of the metal shell and collector straps was virtually nonexistent.

In view of my invention and disclosure, variations and modifications will doubtless become evident to others skilled in the art. I claim all embodiments thereof insofar as they fall within the reasonable scope of the appended claims.

What is claimed is:

1. An improved reduction cell comprising a metal shell, a layer of carbonaceous material for containing electrolyte, the carbonaceous material permeable by sodium, an insulative layer of aluminum fluoride disposed intermediate the metal shell and the layer of carbonaceous material, said aluminum fluoride being reactive with sodium permeating said carbonaceous layer thereby preventing substantial corrosive attack by the sodium of the shell.

2. The reduction cell according to claim 1 including an aluminum reduction cell.

3. The cell according to claim 1 wherein said metal shell is steel.

4. An improved aluminum reduction cell comprising a steel shell, a layer of carbonaceous material permeable by sodium and a layer of aluminum fluoride disposed intermediate the steel shell and the layer of carbonaceous material, the aluminum fluoride being reactive with sodium permeating said carbonaceous layer thereby preventing corrosive attack of the steel shell by the sodium.

5. In the method of operating an aluminum reduction cell having a steel shell, a carbonaceous cathode liner therein adapted for containing molten aluminum and molten electrolyte, said liner permeable by sodium in said electrolyte, said cell having a collector bar extending through said steel shell and being embedded in said carbonaceous cathode liner, said bar connected by at least one collector strap to a bus bar, said improvement comprising providing a layer of aluminum fluoride disposed intermediate said carbonaceous liner and said steel shell, said aluminum fluoride reactive with said sodium permeating said carbonaceous liner thereby preventing substantial corrosion attack by said sodium of said shell and said straps.

* * * * *